US010718513B2

(12) United States Patent
Takeuchi et al.

(10) Patent No.: US 10,718,513 B2
(45) Date of Patent: Jul. 21, 2020

(54) BURNER

(71) Applicant: RINNAI CORPORATION, Aichi (JP)

(72) Inventors: Masaru Takeuchi, Nagoya (JP); Takashi Ojiro, Nagoya (JP)

(73) Assignee: Rinnai Corporation, Aichi (JP)

( * ) Notice: Subject to any disclaimer, the term of this patent is extended or adjusted under 35 U.S.C. 154(b) by 257 days.

(21) Appl. No.: 16/038,760

(22) Filed: Jul. 18, 2018

(65) Prior Publication Data

US 2019/0032916 A1 Jan. 31, 2019

(30) Foreign Application Priority Data

Jul. 31, 2017 (JP) ..... 2017-148206

(51) Int. Cl.

| | |
|---|---|
| ***F23D 14/64*** | (2006.01) |
| ***F23D 14/02*** | (2006.01) |
| ***F23D 14/14*** | (2006.01) |
| ***F23D 14/58*** | (2006.01) |

(52) U.S. Cl.

CPC ..... *F23D 14/64* (2013.01); *F23D 14/02* (2013.01); *F23D 14/145* (2013.01); *F23D 14/583* (2013.01); *F23D 2203/103* (2013.01); *F23D 2208/10* (2013.01); *F23D 2212/201* (2013.01); *F23D 2900/00019* (2013.01); *F23D 2900/14001* (2013.01)

(58) Field of Classification Search

CPC ..... F23D 14/02; F23D 14/14; F23D 14/64; F23D 14/58

See application file for complete search history.

(56) References Cited

U.S. PATENT DOCUMENTS

| | | | | |
|---|---|---|---|---|
| 4,504,218 A * | 3/1985 | Mihara | F23D 14/14 431/326 |
| 5,360,490 A * | 11/1994 | Nelson | F23D 14/12 136/253 |
| 10,281,173 B2 * | 5/2019 | Naitoh | F24H 9/2035 |
| 10,527,279 B2 * | 1/2020 | Ojiro | F24H 1/124 |

(Continued)

FOREIGN PATENT DOCUMENTS

| | | | | |
|---|---|---|---|---|
| JP | 08136013 | * | 5/1996 | F23D 14/02 |
| JP | 2001235117 A | * | 8/2001 | F23D 14/14 |
| JP | 2014-009839 A | | 1/2014 | |

*Primary Examiner* — Edelmira Bosques
*Assistant Examiner* — Nikhil P Mashruwala
(74) *Attorney, Agent, or Firm* — Cermak Nakajima & McGowan LLP; Tomoko Nakajima

(57) ABSTRACT

A burner has: a combustion plate part for ejecting air-fuel mixture; and a flame rod which lies opposite to a portion of the combustion plate part which has a picture-frame-like burner frame; a metal-fiber knit which covers an opening enclosed by the burner frame; and a distribution plate which has formed therein distribution holes and which sandwiches the metal-fiber knit between the burner frame and the distribution plate through the distribution holes and the metal-fiber knit. The flame rod has: a rod base part which lies opposite to a portion of opening peripheral part of the burner frame which is positioned on the same surface level as the opening; and a rod main body part which lies opposite to a portion of the metal-fiber knit. The distance between the rod base part and the opening peripheral part is made smaller than the distance between the rod main body part and the metal-fiber knit.

2 Claims, 10 Drawing Sheets

(56) References Cited

U.S. PATENT DOCUMENTS

| | | | | |
|---|---|---|---|---|
| 10,612,776 | B2 * | 4/2020 | Ono | F23D 14/36 |
| 2008/0145806 | A1 * | 6/2008 | Ojiro | F23D 14/36<br>431/181 |
| 2009/0226854 | A1 * | 9/2009 | Ojiro | F23D 14/78<br>431/351 |
| 2010/0294214 | A1 * | 11/2010 | Lee | F23D 14/583<br>122/17.1 |
| 2010/0316967 | A1 * | 12/2010 | Scribano | F23D 14/14<br>431/329 |
| 2018/0209640 | A1 * | 7/2018 | Asai | F23D 14/045 |
| 2019/0024941 | A1 * | 1/2019 | Ono | F23D 14/145 |
| 2019/0186785 | A1 * | 6/2019 | Ono | F23D 14/14 |

* cited by examiner

BURNER

TECHNICAL FIELD

The present invention relates to a burner comprising: a combustion plate part through which air-fuel mixture is ejected; and a flame rod which lies opposite to a portion of the combustion plate part.

BACKGROUND ART

In this kind of burner, there is conventionally known one in which the combustion plate part is constituted by: a burner frame in the shape of a picture frame; a metal-fiber knit (i.e., a metal knit formed of a heat resistant metal fiber) which is disposed to cover an opening enclosed by the burner frame; and a distribution plate which has formed therein a multiplicity of distribution holes and which sandwiches the metal-fiber knit between the burner frame and the distribution plate. Air-fuel mixture is thus arranged to be ejected through the distribution holes and the metal-fiber knit (see, for example, JP-A-2014-9839). Further, the flame rod is disposed in a manner to lie opposite to a portion of the opening enclosed by the burner frame, i.e., to lie opposite to a portion of the metal-fiber knit.

When the flame rod gets heated as a result of exposure to the flame, components such as aluminum and the like contained in the constituent material of the rod will be precipitated on the surface and are oxidized, and will be coated by an oxidizing film such as aluminum oxide and the like. In this manner, thanks to the oxidizing film the heat-resisting property of the flame rod can be secured. Although the oxidizing film has insulating properties, the oxidizing film will give rise to cracks, during burner combustion, due to expansion by heating of the flame rod. As a result, ions in the flame will come into contact, through the cracks, with the base material of the flame rod, thereby causing flame current to flow. However, it takes some time for the oxidizing film to give rise to cracks after ignition, and therefore the flame detection cannot be made during that period of time.

SUMMARY

Technical Problem

In view of the above-mentioned points, this invention has a problem of providing a burner which is arranged to be capable of detecting the flame by the flame rod after ignition with good response.

Solution to Problem

In order to solve the above problem, this invention is a burner comprising: a combustion plate part through which air-fuel mixture is ejected; and a flame rod which lies opposite to a portion of the combustion plate part. The combustion plate part is constituted by: a burner frame in a shape of a picture frame; a metal-fiber knit which covers an opening enclosed by the burner frame; and a distribution plate which has formed therein a multiplicity of distribution holes and which sandwiches the metal-fiber knit between the burner frame and the distribution plate so that the air-fuel mixture is arranged to be ejected from the opening through the distribution holes and the metal-fiber knit. The flame rod comprises: a rod base part which lies opposite to a portion of opening peripheral part of the burner frame which is positioned on the same surface level as the opening; and a rod main body part which lies opposite to a portion of the metal-fiber knit. The distance between the rod base part and the opening peripheral part is made smaller than the distance between the rod main body part and the metal-fiber knit.

At an initial period of ignition, the ions generated in the course of the combustion reaction of the air-fuel mixture to be ejected from the metal-fiber knit will be dispersed also to the neighborhood of the surface of that opening peripheral part of the burner frame which is positioned on the outside of the opening. According to this invention, at the initial period of ignition, the above-mentioned ions come into contact with the rod base part that lies opposite to the opening peripheral part. Since the rod base part is not intensely heated, it is not coated with an oxidizing film. Therefore, after ignition, the flame current flows immediately at the point of time when the ions generated in the course of the combustion reaction come into contact with the rod base part. As a result, the flame can be detected with good response after ignition. By the way, after a lapse of sometime from the ignition, the ions cease to be dispersed to the outside of the opening. However, at this point of time, the oxidizing film of the rod main body part gives rise to cracks, and the ions come into contact with the base material of the flame rod through the cracks, thereby causing flame current to flow.

By the way, also in the conventional example, the flame rod has: a rod base part which lies opposite to a portion of the opening peripheral part of the burner frame; and a rod main body part which lies opposite to a portion of the metal-fiber knit. However, the distance between the rod base part and the opening peripheral part is equivalent to the distance between the rod main body and the metal-fiber knit. In this kind of flame rod, if the distance between the rod base part and the opening peripheral part is made smaller so that the rod base part falls within a range closer to that surface of the opening peripheral part at which the ions generated in the course of the combustion reaction at the initial period of ignition get dispersed, there will be the following disadvantage. That is, the rod main body part becomes too close to the metal-fiber knit, and frayed fibers of the metal-fiber knit will, therefore, come into contact with the rod main body part. The wrong flame detection may occur. On the other hand, according to this invention, even if the distance between the rod base part and the opening peripheral part is made smaller, it is still possible to make larger the distance between the rod main body and the metal-fiber knit. It is thus possible to make the frayed fibers not to come into contact with the rod main body part.

Further, according to this invention, preferably the rod base part is disposed so as to lie along a longitudinal direction of the opening peripheral part. According to this arrangement, there will increase the probability in that the ions dispersed to the outside of the open peripheral part at the initial period of ignition will contact the rod base end part. As a result, the surety of flame detection can be improved.

DESCRIPTION OF EMBODIMENTS

Figure 1:
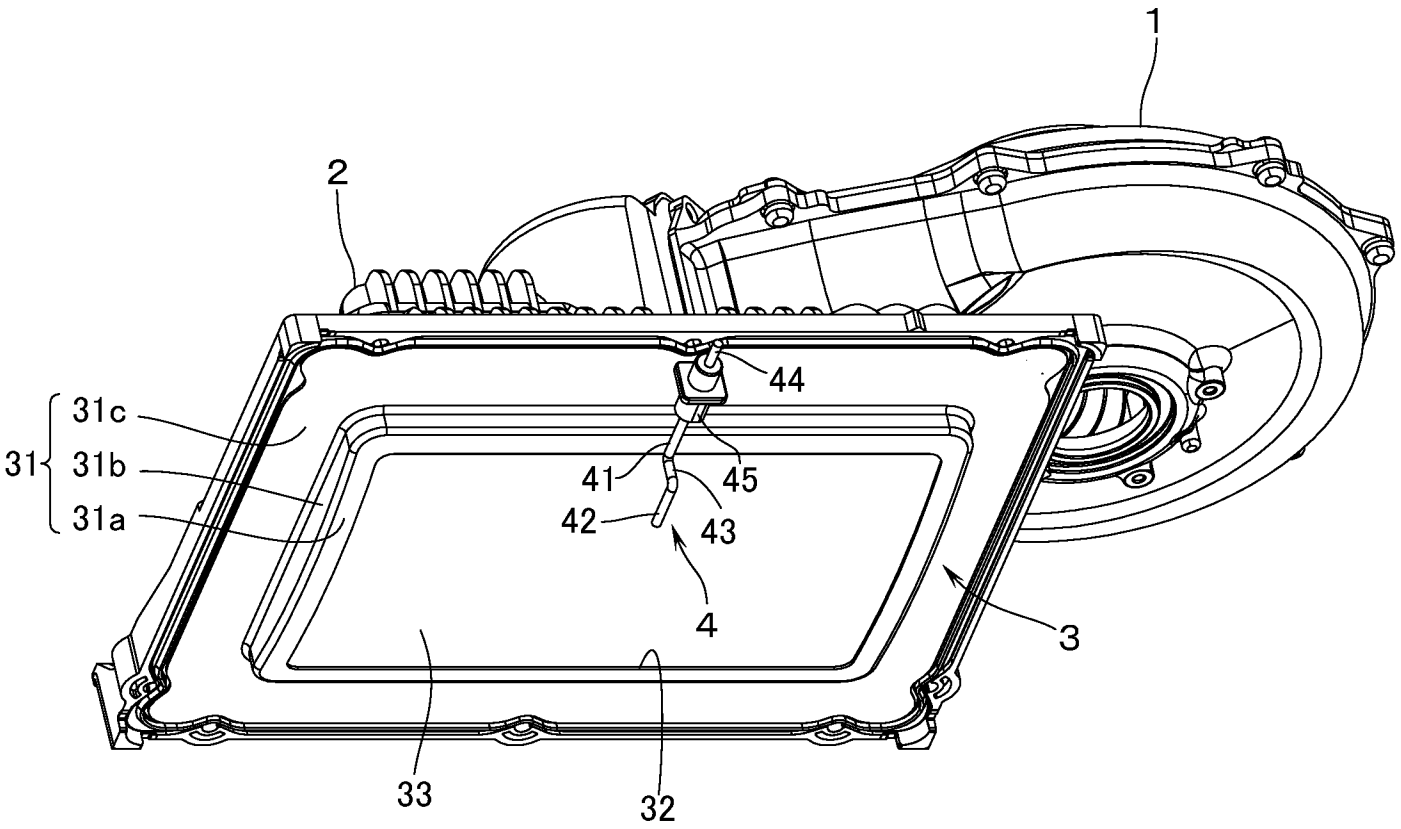
FIG. 1 is a perspective view of a burner according to a first embodiment of this invention.
Figure 2:
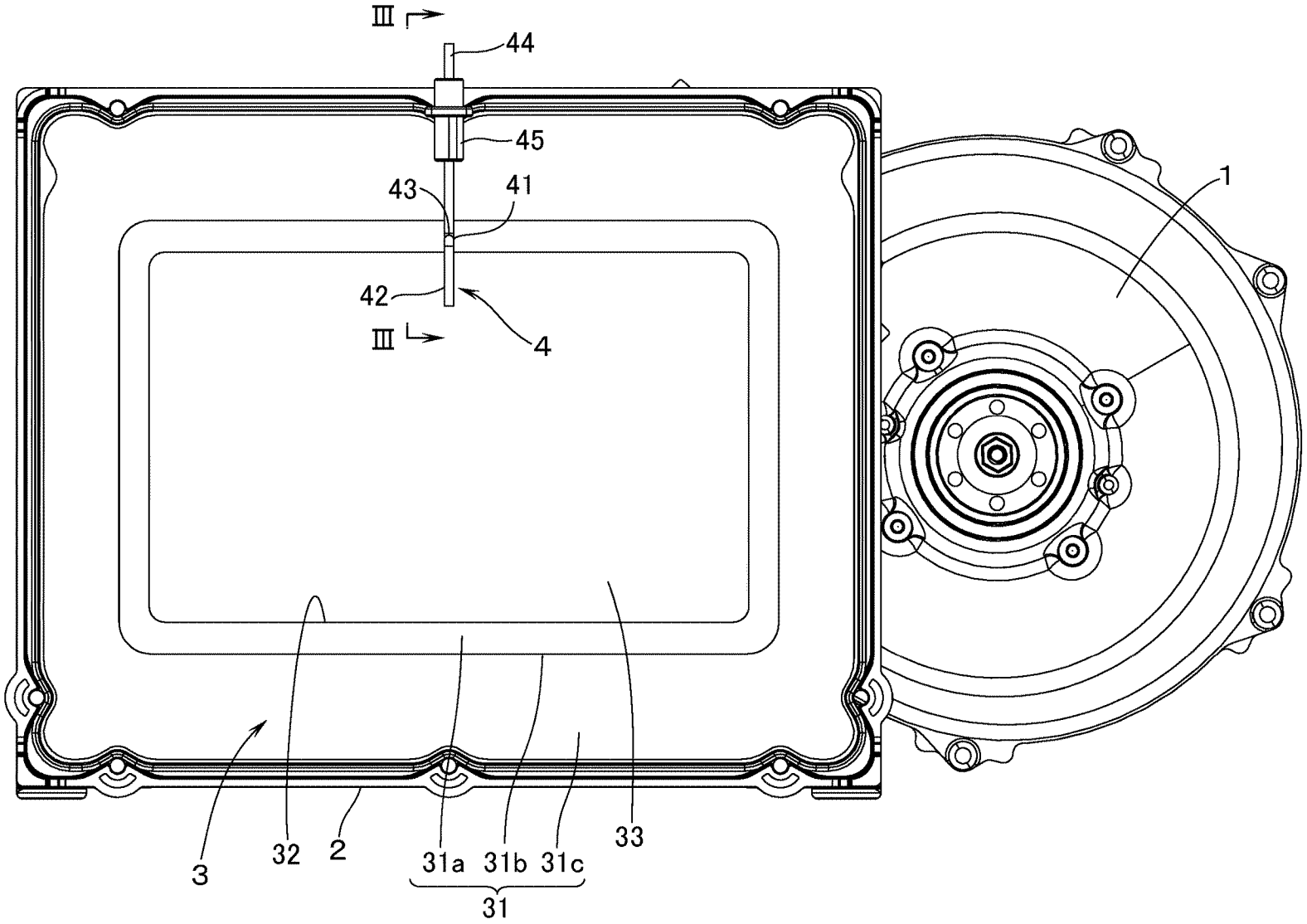
FIG. 2 is a bottom view of the burner according to the first embodiment.
Figure 4:
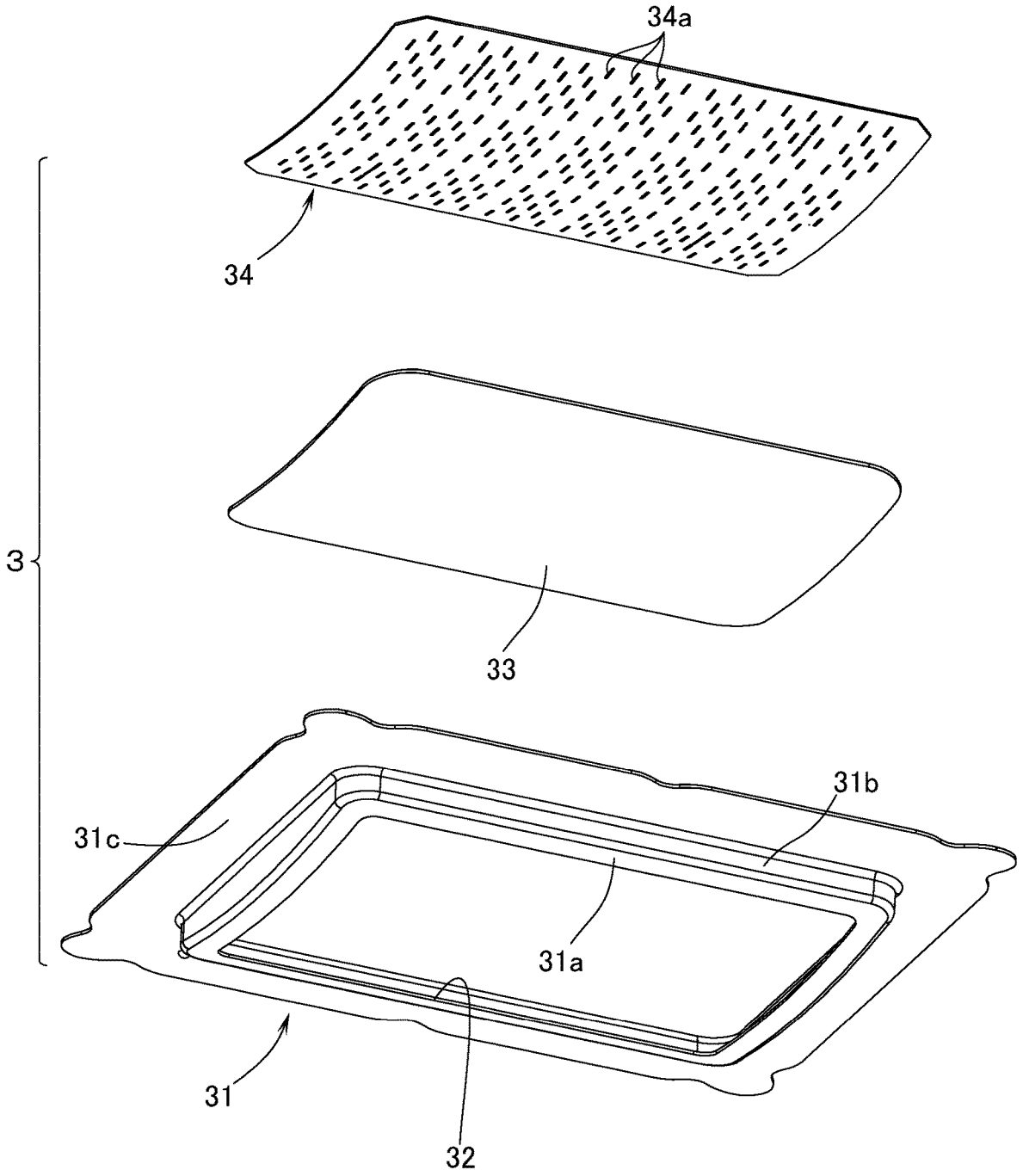
FIG. 4 is a perspective view in an exploded state of the combustion plate part.

With reference to FIGS. 1 and 2, the burner according to an embodiment of this invention is provided with: a box-shaped burner body 2 to which air-fuel mixture of fuel gas and primary air is supplied through a fan 1 and which opens downward; and a combustion plate part 3 which covers a lower surface of the burner body 2. As shown in FIG. 4, the combustion plate part 3 is constituted by: a burner frame 31 in the shape of a picture frame; a metal-fiber knit 33 which covers, from an upper side, an opening 32 enclosed by the burner frame 31; and a distribution plate 34 which has formed therein a multiplicity of slit-shaped distribution holes 34*a* and which sandwiches the metal-fiber knit 33 between the distribution plate 34 and the burner frame 31. Further, a flame rod 4 is disposed so as to lie opposite to a portion of the combustion plate part 3. By the way, the opening 32 is curved into an arcuate shape in cross section along the front-to-back direction (vertical direction in FIG. 2) and, similarly, the metal-fiber knit 33 and the distribution plate 34 are also respectively curved into an arcuate shape in cross section along the front-to-back direction.

Figure 3:
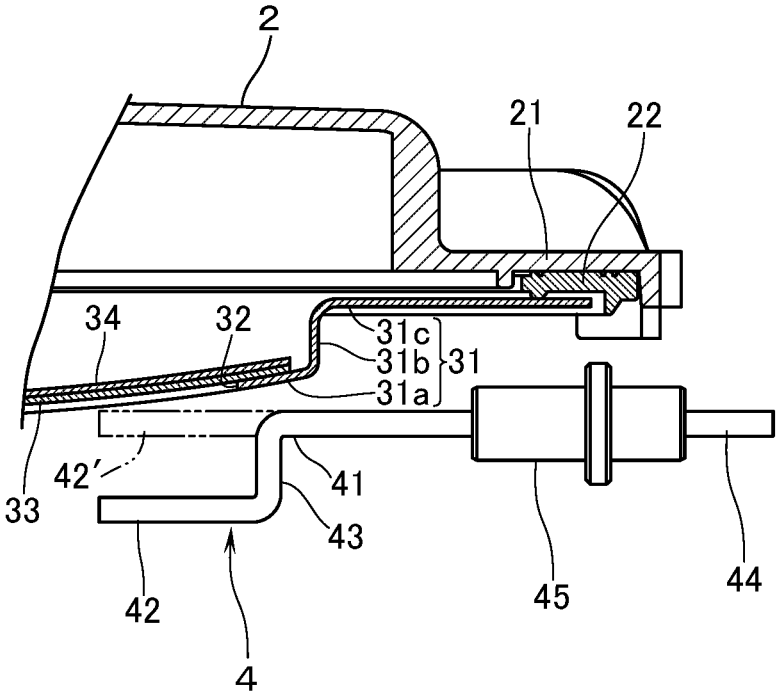
FIG. 3 is an enlarged sectional view cut along the line III-III in FIG. 2.

The burner frame 31 has: an opening peripheral part 31*a* which is positioned on the same surface level as the opening 32; a side plate part 31*b* which is bent from the opening peripheral part 31*a* upward; and a flange part 31*c* which protrudes outward from an upper end of the side plate part 31*b*. Then, as shown in FIG. 3, the burner frame 31 is hermetically coupled, at its flange part 31*c* through a packing 22, to a body flange part 21 in a periphery of the lower surface of the burner body 2. Further, in a state in which the distribution plate 34 is overlapped on the metal-fiber knit 33, the peripheral parts of the metal-fiber knit 33 and the distribution plate 34 are respectively fixed by spot-welding to the opening peripheral part 31*a*.

With reference also to FIG. 3, the flame rod 4 has: a rod base part 41 which lies opposite to a portion of the opening peripheral part 31*a* of the burner frame 31; and a rod main body part 42 which lies opposite to a portion of the metal-fiber knit 33. Between the rod base part 41 and the rod main body part 42, there is provided a bent part 43 bent in the vertical direction. An arrangement is made that the distance between the rod base part 41 and the opening peripheral part 31*a* is smaller than the distance between the rod main body part 42 and the metal-fiber knit 33. In addition, the flame rod 4 has a lead-out rod part 44 which is elongated outside beyond a combustion box (not illustrated) which encloses the space, under the burner, for combustion of the air-fuel mixture. An insulator 45 is mounted at a portion through which the lead-out rod part 44 penetrates the combustion box.

At the initial period of ignition, the ions generated in the course of the combustion reaction of the air-fuel mixture to be ejected from the metal-fiber knit 33 get dispersed also to the neighborhood of the surface of the opening peripheral part 31*a*. These ions come into contact with the rod base part 41. Since the rod base part 41 is not intensely heated, it is not covered by an oxidizing film. Therefore, after ignition, the flame current flows immediately at the point of time when the ions generated in the course of the combustion reaction come into contact with the rod base part 41. As a result, the flame can be detected with good response after ignition. After a lapse of sometime from the ignition, the ions cease to be dispersed to the outside of the opening 32. However, at this point of time, the oxidizing film of the rod main body part 42 gives rise to cracks, and the ions come into contact with the base material of the flame rod 4 through the cracks, thereby causing flame current to flow.

By the way, it is conceivable to arrange the flame rod 4 so that it has a rod main body part 42', as shown in imaginary lines in FIG. 3, which extends from the rod base part 41 into the opening 32 without being provided with the bent part 43. In this arrangement, too, if the distance between the rod base part 41 and the opening peripheral part 31*a* is made smaller, the ions to be generated in the course of the combustion reaction at the initial period of ignition come into contact with the rod base part 41, so that the flame detection can be made with good response after ignition. However, in this arrangement, the rod main body part 42' will be too close to the metal-fiber knit 33, so that the frayed fibers of the metal-fiber knit 33 may come into contact with the rod main body part 42', whereby wrong detection may take place. On the other hand, according to the above-mentioned embodiment, even if the distance between the rod base part 41 and the opening peripheral part 31*a* becomes too small, the distance between the rod main body part 42 and the metal-fiber knit 33 is made larger. As a result, it is possible to prevent the frayed fibers of the metal-fiber knit 33 from getting into contact with the rod main body part 42.

Figure 5:
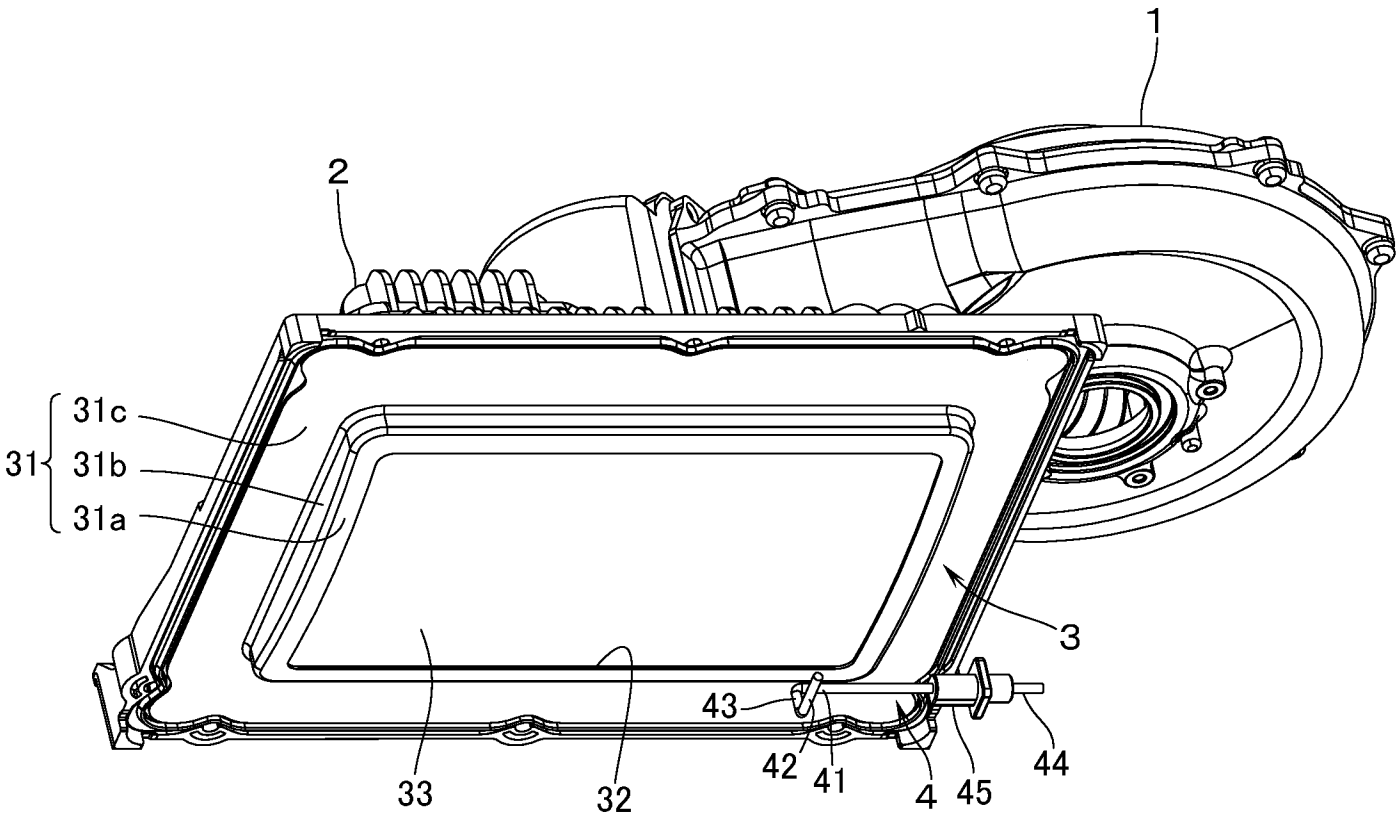
FIG. 5 is a perspective view of the burner according to a second embodiment.
Figure 6:
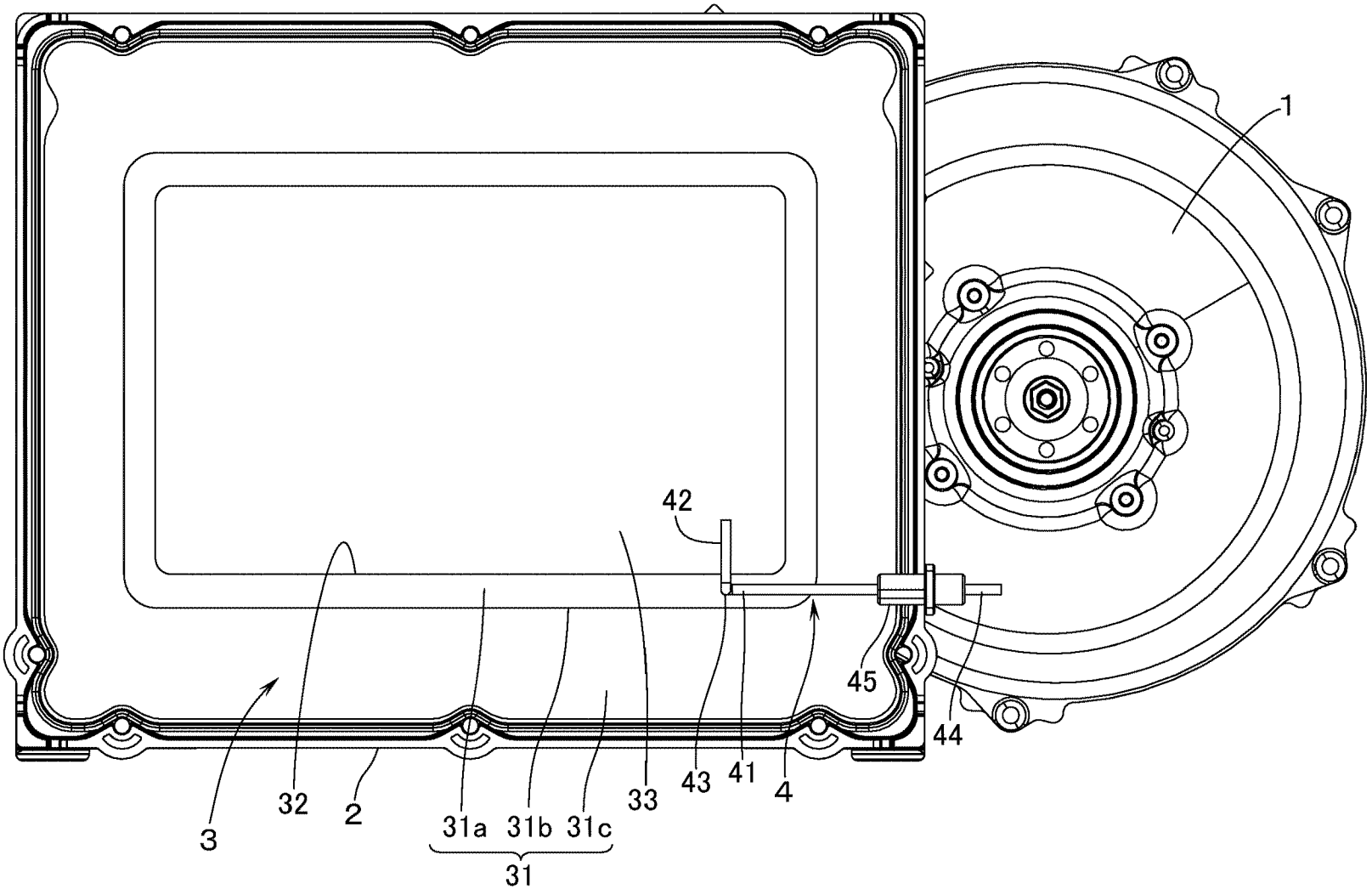
FIG. 6 is a bottom view of the burner according to the second embodiment.
Figure 7:
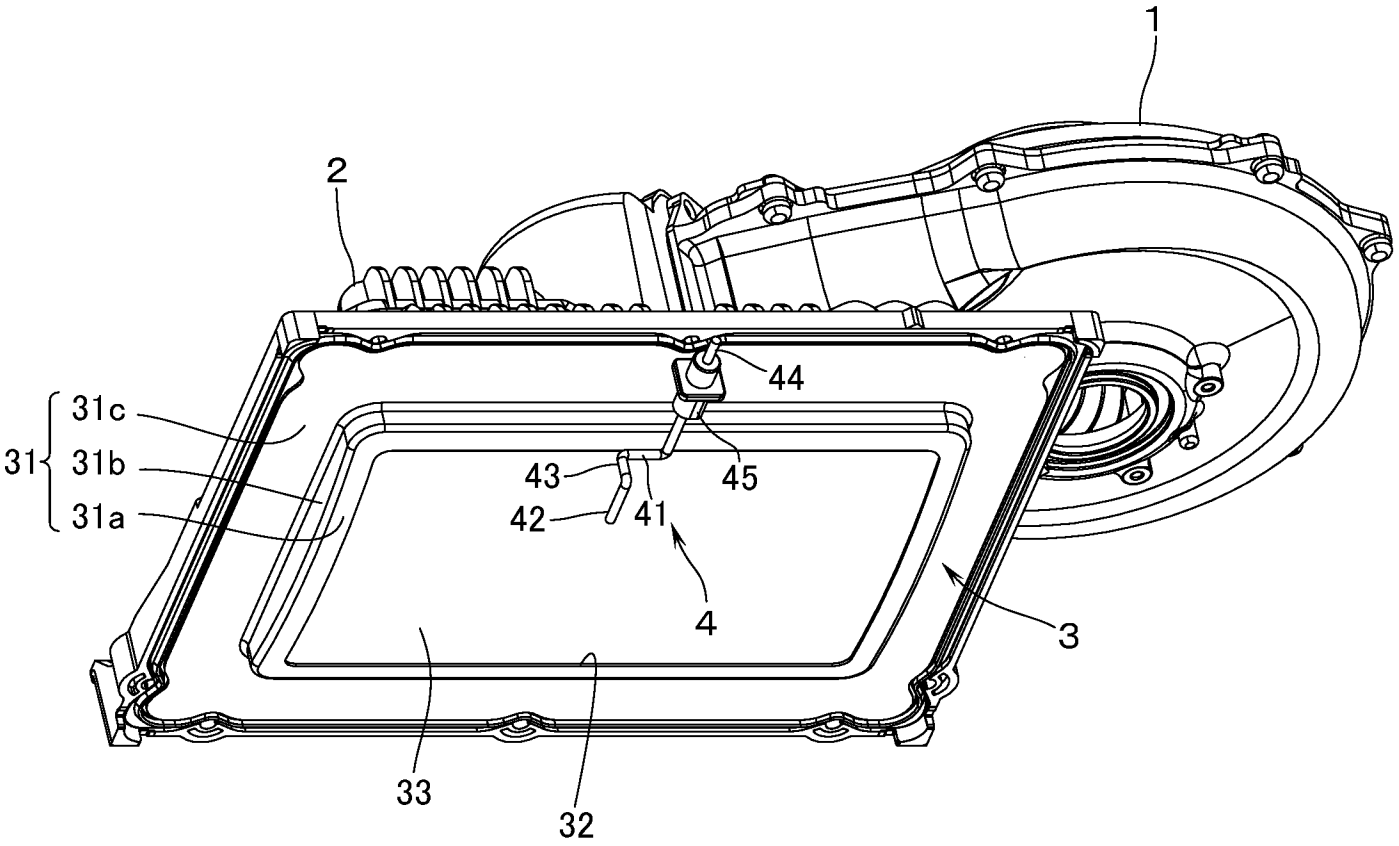
FIG. 7 is a perspective view of the burner according to a third embodiment.
Figure 8:
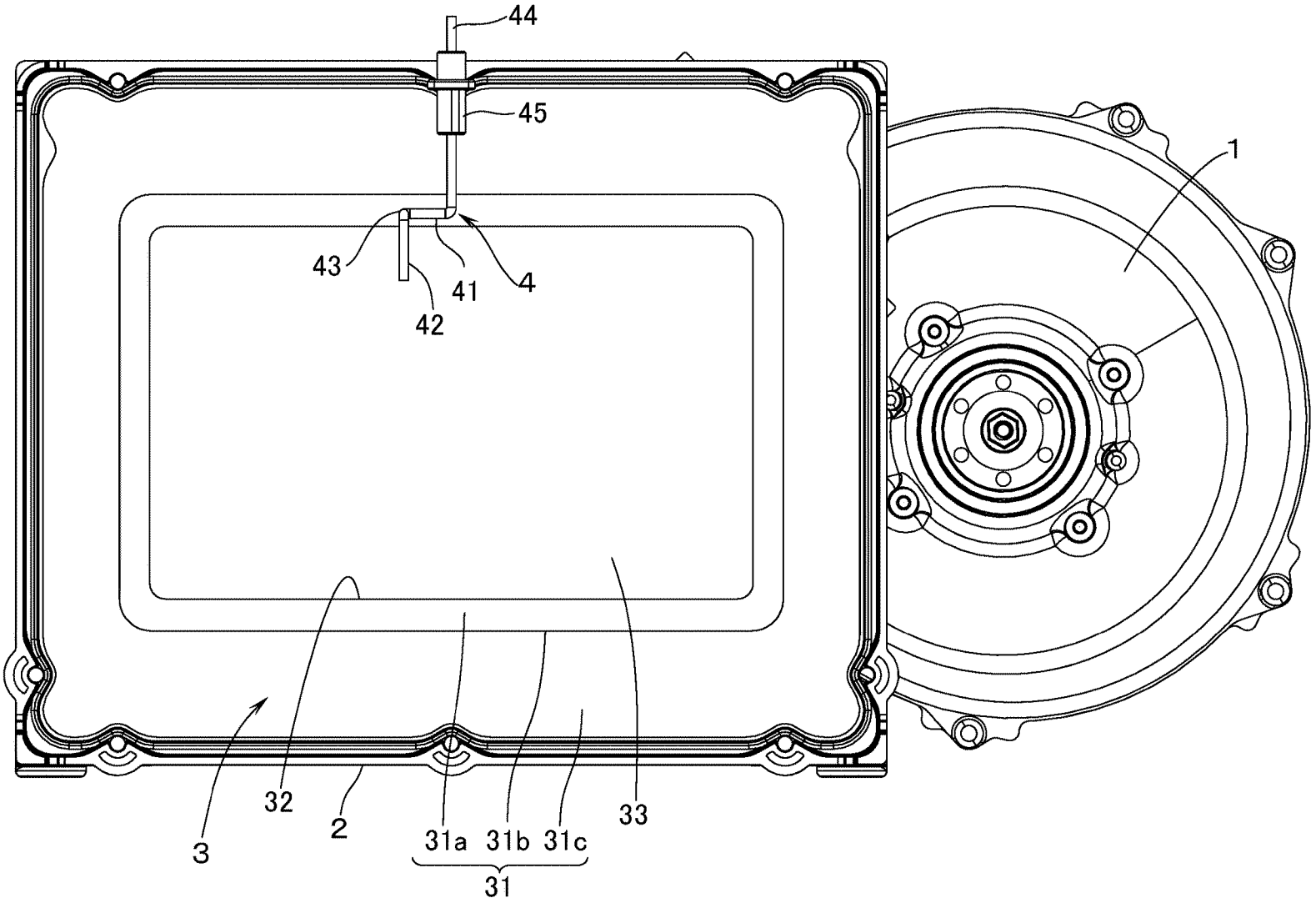
FIG. 8 is a bottom view of the burner according to the third embodiment.

By the way, in the above-mentioned embodiment (first embodiment), the entire flame rod 4 is disposed to be in a direction at right angles to the longitudinal direction (lateral direction) of the opening peripheral part 31*a* of the burner frame 31. This invention shall, however, be not limited to the above. In other words, according to a second embodiment as shown in FIGS. 5 and 6, an arrangement may be made that the portion from the lead-out rod part 44 of the flame rod 4 to the rod base part 41 is disposed so as to lie along the longitudinal direction (lateral direction) of the opening peripheral part 31*a*. Alternatively, according to a third embodiment as shown in FIGS. 7 and 8, an arrangement may be made that, relative to the lead-out rod part 44 disposed to lie at right angles to the longitudinal direction (lateral direction) of the opening peripheral part 31*a* of the burner frame 31, the rod base part 41 may be bent sidewise so that the rod base part 41 is disposed to lie along the longitudinal direction of the opening peripheral part 31*a*. By the way, in the second and third embodiments, the rod main body part 42 is bent so as to be elongated inward of the opening 32, relative to the downward bent part 43 at the tip of the rod base part 41.

Like in the second and third embodiments, by disposing the rod base part 41 in a manner to lie along the longitudinal direction of the opening peripheral part 31*a*, the rod base part 41 will be elongated along the side edge of the opening 32. Therefore, the ions that will be dispersed outside of the opening 32 at the initial period of ignition will come into contact with the rod base part 41 at higher probability, whereby the surety of flame detection can be improved.

Figure 9:
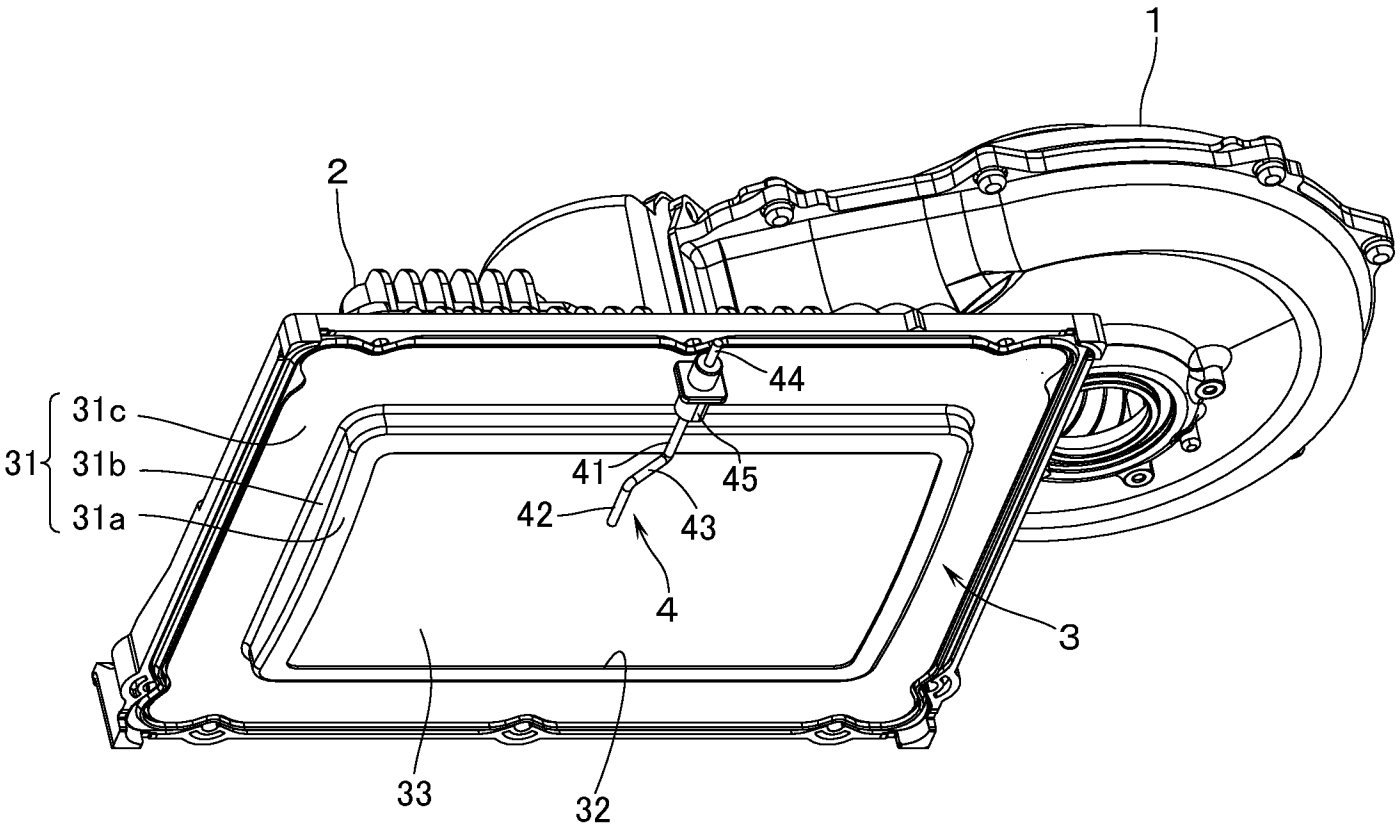
FIG. 9 is a perspective view of the burner according to a fourth embodiment.
Figure 10:
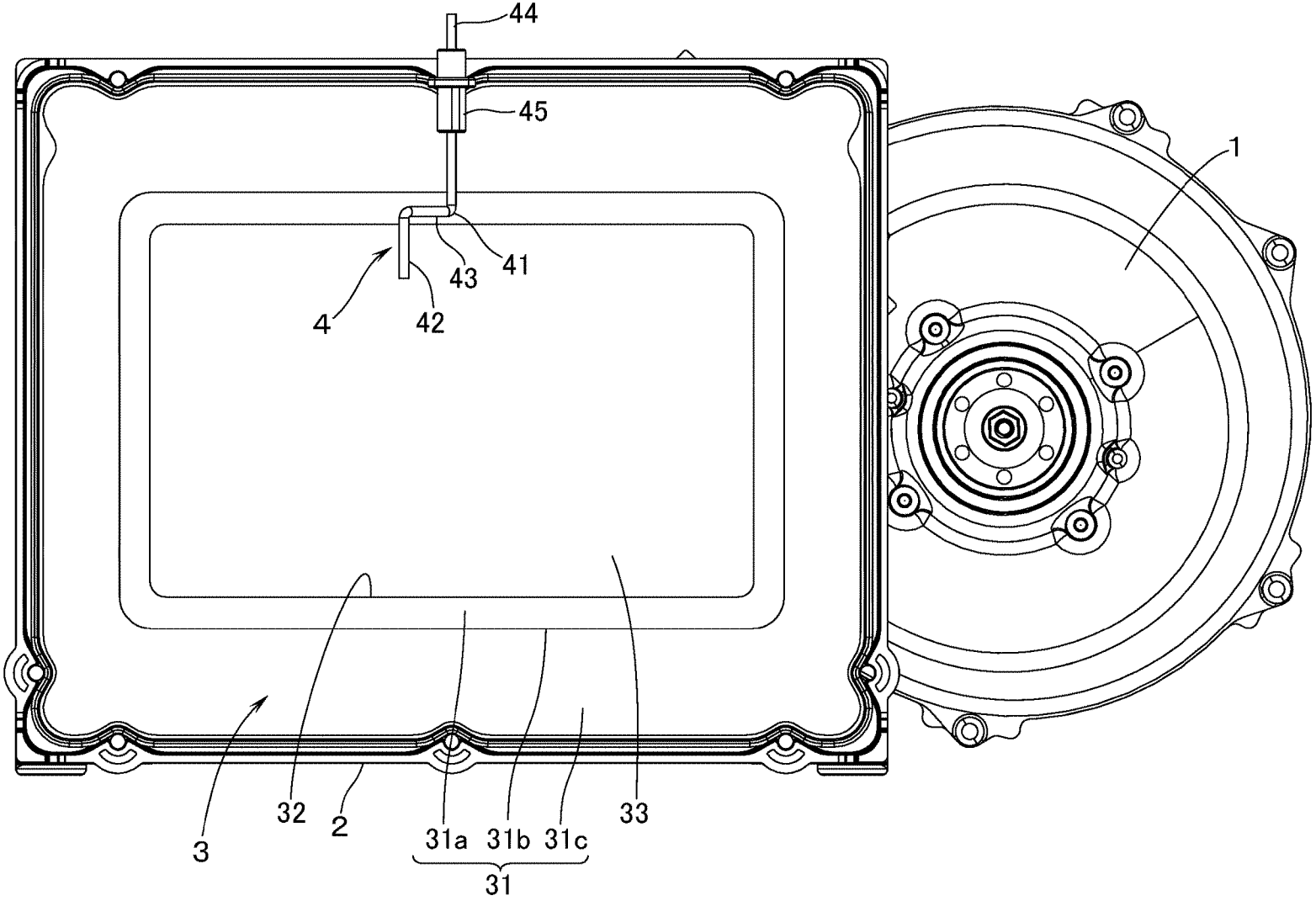
FIG. 10 is a bottom view of the burner according to the fourth embodiment.

Further, as in a fourth embodiment as shown in FIGS. 9 and 10, the portion from the lead-out rod part 44 to the rod base part 41 may be disposed to lie in a direction at right angles to the longitudinal direction (lateral direction) of the opening peripheral part 31*a*. The bent part 43 is then bent laterally in a downward inclined manner, and is bent in a front-to-back direction so that the rod main body part 42 can be elongated inward of the opening 32 relative to the bent part 43.

Descriptions have so far been made of embodiments of this invention with reference to the drawings. However, this invention shall not be limited to the above. For example, in the above-mentioned embodiments, the combustion plate part 3 is disposed to look downward so that the air-fuel mixture is ejected downward, but this invention is similarly applicable to the burner whose combustion plate part is disposed to look upward or sidewise.

REFERENCE SIGNS LIST

3 combustion plate part 31 burner frame

31*a* opening peripheral part 32 opening 33 metal-fiber knit (metal knit formed of a heat resistant metal fiber)

34 distribution plate 34*a* distribution hole

4 flame rod 41 rod base part 42 rod main body part

The invention claimed is:

1. A burner comprising:

a combustion plate part through which air-fuel mixture is ejected; and a flame rod which lies opposite to a portion of the combustion plate part, wherein the combustion plate part is constituted by: a burner frame in a shape of a picture frame; a metal-fiber knit which covers an opening enclosed by the burner frame; and a distribution plate which has formed therein a multiplicity of distribution holes and which sandwiches the metal-fiber knit between the burner frame and the distribution plate so that the air-fuel mixture is arranged to be ejected from the opening through the distribution holes and the metal-fiber knit, wherein the flame rod comprises: a rod base part which lies opposite to a portion of opening peripheral part of the burner frame which is positioned on a same surface level as the opening; and a rod main body part which lies opposite to a portion of the metal-fiber knit, wherein a distance between the rod base part and the opening peripheral part is made smaller than a distance between the rod main body part and the metal-fiber knit.

2. The burner according to claim 1, wherein the rod base part is disposed so as to lie along a longitudinal direction of the opening peripheral part.

* * * * *